US007493931B2

(12) United States Patent
Deiderich

(10) Patent No.: US 7,493,931 B2
(45) Date of Patent: Feb. 24, 2009

(54) VIBRATING TILE SETTING TOOL

(75) Inventor: Jeffrey D. Deiderich, Suamico, WI (US)

(73) Assignee: Sure Set Manufacturing Inc., Green Bay, WI (US)

( * ) Notice: Subject to any disclaimer, the term of this patent is extended or adjusted under 35 U.S.C. 154(b) by 956 days.

(21) Appl. No.: 10/923,114

(22) Filed: Aug. 20, 2004

(65) Prior Publication Data

US 2005/0055979 A1 Mar. 17, 2005

Related U.S. Application Data

(60) Provisional application No. 60/496,527, filed on Aug. 20, 2003.

(51) Int. Cl.

| | |
|---|---|
| ***B32B 37/10*** | (2006.01) |
| ***B32B 39/00*** | (2006.01) |
| ***E04F 21/18*** | (2006.01) |
| ***E04G 21/16*** | (2006.01) |

(52) U.S. Cl. ..... 156/579; 156/580; 52/749.11; 318/114

(58) Field of Classification Search ..... 156/71, 156/73.6, 579, 580; 52/749.1, 749.11; 318/114
See application file for complete search history.

(56) References Cited

U.S. PATENT DOCUMENTS

| | | | | |
|---|---|---|---|---|
| 3,183,891 | A * | 5/1965 | MacDonald | 15/3.53 |
| 3,579,000 | A * | 5/1971 | Mathews | 310/15 |
| 3,673,755 | A | 7/1972 | Christ | |
| 3,678,645 | A | 7/1972 | Valdes | |
| 4,893,451 | A | 1/1990 | Valente | |
| 5,656,018 | A * | 8/1997 | Tseng | 601/112 |
| 5,867,965 | A | 2/1999 | Pilz et al. | |

* cited by examiner

*Primary Examiner*—Philip C Tucker
*Assistant Examiner*—Sing P Chan
(74) *Attorney, Agent, or Firm*—Wilhelm Law Service; Thomas J. Connelly; Thomas D. Wilhelm

(57) ABSTRACT

A light weight vibrating tile setting tool, optionally having a self-contained power supply, vibrates at high frequency while setting/leveling tiles during a tile installation process. The tool comprises a housing which houses a vibration mechanism which includes a motor. An off-set weight 75 is attached to an output shaft of the motor. Rotation of the shaft, and off-set weight, causes the entire tool to vibrate. Ratio of frequency of vibration to mass of the tool is at least 200 vibrations per minute per pound mass. The high frequency of vibration causes a tile, to which the tile setting tool is applied, to be easily manipulated, by the user of the tile setting tool, into its set location in an array of such tiles.

50 Claims, 9 Drawing Sheets

VIBRATING TILE SETTING TOOL

CROSS REFERENCE TO RELATED APPLICATIONS

This application is a Non-Provisional Application, claiming priority under 35 U.S.C. 119(e) to U.S. Provisional Application Ser. No. 60/496,527, filed Aug. 20, 2003, which is incorporated herein by reference in its entirety.

BACKGROUND

The present invention relates generally to power tools, and more particularly, to vibration power tools for use in the construction trades such as for example for use in the process of installing tile.

Tiles, e.g. ceramic, natural stone such as granite, marble, slate, limestone, and other tiles, are often installed on floors, walls, and elsewhere during new construction of commercial buildings, residential buildings, and other dwellings and/or structures, as well as during remodeling of such structures. Some tile floors offer advantages over other, non-tile floors. These advantages include durability, ease of maintenance, and aesthetic value as viewed by some individuals.

Often, tiles are installed by skilled craftsman. Tile installation, even when performed by such skilled craftsman, can be a laborious and time-consuming undertaking. Accordingly, when tile installation is performed by e.g. someone other than a skilled craftsman, the installation process is relatively more laborious and more time consuming compared to when such installation is performed by such skilled craftsman.

A typical floor tile installation procedure generally includes various preliminary preparation steps, adhesion of the tiles to the floor, and finish work. Specifically, a tile installer prepares the floor or sub-floor, or other substrate surface, by installing plywood, cement backer-board, or other sufficiently rigid building material as a substrate over the existing floor or sub-floor, or wall, etc., as necessary. Optionally, a layer of roofing felt and/or a wire mesh is installed directly over the substrate e.g. plywood or cement backer-board, as part of the tile installation preparation.

Once the substrate is adequately prepared, the installer can determine the specific proposed tile layout and can correspondingly draw reference and/or layout lines to aid in subsequent tile placement. Typically, at least one row of tiles is test-fit against the reference line/lines to enable the installer to visually inspect the proposed tile layout. As one example of a visual inspection, the installer may check to confirm that full tiles are placed in a relatively more visible part of the room while tiles requiring cutting are placed in a relatively less visible part of the room.

The installer then applies a layer of adhesive onto the substrate. Adhesive is typically referred to in the trade as "mud," and includes e.g. thinset (also known in the trade as "dry-set") mortar, mastic, and/or other adhesives. Typically, the adhesive is applied to the substrate in multiple applications. Each adhesive application covers less than the entire surface area of the substrate. The ideal adhesive application coverage area of each adhesive application corresponds to the surface area of tile which the installer can lay before the adhesive dries to a non-desired, less adhesively effective state.

Each of the adhesive applications is applied, sometimes referred to as "combed out," onto the substrate with for example a notched trowel, preferably to realize an adhesive layer having generally uniform characteristics such as thickness. The shapes of the notches in the trowel correspond to the type of adhesive used. As one example, trowels with v-shaped notches are typically used with mastic adhesives while trowels with square-shaped notches are typically used with thinset adhesives.

After each adhesive application, the installer lays individual tiles on the adhesive layer. Each tile is laid on the adhesive, and is typically slightly twisted laterally, to and fro, and downwardly into the adhesive. The twisting of the tile enhances the area of contact between adhesive on the back of the tile and thus enhances the spread of the adhesive on the back of the tile, thereby enhancing the level of adhesion between, level of bonding, grip, between the tile and the adhesive. Preferably, the installer applies enough pressure to the tile while twisting the tile into place to ensure a desired level of adhesive coverage on the back of the tile, while not applying so much pressure as to force adhesive laterally into the joints between adjacent tiles and/or upwardly out of the joints.

Once the installer has laid the tiles into the adhesive, the installer "sets" and/or "levels" the tiles so as to establish a relatively level upper collective surface of the array of tiles or the tile area on which the work is being performed. Typical methods of setting tile include tapping or otherwise striking individual tiles with a rubber mallet, grout float, or placing e.g. a padded piece of wood on the tile and tapping such piece of wood with a hammer.

Setting tile and thus creating a relatively level surface across the collective tile upper surface area is viewed as advantageous, by some, for numerous reasons. As one example, a relatively level tile floor is viewed by some as more aesthetically pleasing than a relatively non-level tile floor. As another example, a relatively level tile floor provides a more uniform and consistent walking surface than a relatively non-level tile floor and thus is correspondingly safer to walk upon, with relatively lesser risk of causing a tripping accident.

Once the tiles are set and the adhesive is dry, grout is applied to the tile surface and forced between adjacent tiles into e.g. the joints. Excess grout is wiped from the surface of the tiles by preferably a damp sponge, damp cloth, or otherwise. If desired, the joints between adjacent tiles can be emphasized by "striking" the grout, in excess of that desired, from the joints with a sponge, a cloth, or a curved instrument.

After the grout has sufficiently dried/cured, a sealer e.g. a silicone sealer can be applied on the grouted joints, thus sealing the grout. Grout sealing is especially desirable when the tile has been installed in an area of the building which is particularly susceptible to exposure to staining substances, dirt and/or mildew.

Thus, it can be seen that tile installation can be laborious and time consuming for the non-craftsman and craftsman alike. It is recognized that the tile installation step of "setting," e.g. "leveling," is particularly crucial to a quality tile installation job and the safety of the post-installation tile floor.

The conventional method of setting/leveling tile, including striking such tile with mallets, grout floats, or other instruments, affects how the back of the tile interface members with, and receives, the adhesive properties, of the adhesive material. Accordingly, if the tile is not properly set, the integrity and strength of the bond between the adhesive and the tile can be compromised.

In addition, conventional means of setting/leveling a tile, e.g. striking the tile with an instrument, poses inherent risks to the integrity of the tile, itself. Specifically, by striking a tile with an instrument, an installer incurs some risk of breaking the tile.

Therefore, it is desirable to provide improved instruments and/or devices and methods for installing tile, e.g. for setting and/or leveling tile.

It is further desirable to provide, e.g. a vibrating tile setting tool enabling a tile installer to set and/or level a tile, including developing a desired level of bonding between the tile and the adhesive, without requiring the installer to strike such tile with any instrument.

It is yet further desirable to provide a highly portable, low mass, vibrating tile setting tool which vibrates at a relatively high frequency of vibration, for use in tile installation.

SUMMARY

This invention is directed toward improved tools and methods for installing tile onto substrates such as floors, walls, or otherwise. More specifically, the invention provides improved tools e.g. low mass, high frequency, vibrating tile setting tools, and methods for vibrating a tile at a relatively high frequency of vibration during a "setting" and/or "leveling" phase of tile installation. Vibrating a tile at a high frequency of vibration enhances the communication between the adhesive and the tile, improves the adhesive coverage and the integrity of contact with the adhesive on the back of the tile, and enables a user of such vibrating tile setting tool to set and/or level the tile generally without any need to strike the tile.

In a first family of embodiments, the invention comprehends a vibrating tile setting tool adapted and configured to interface with an upper surface of a tile, thereby to facilitate setting such tile in mud, the vibrating tile setting tool comprising a housing defined by a plurality of housing walls; and a vibration mechanism mounted on the housing so as to vibrate the housing when the vibration mechanism is activated, the vibration mechanism being effective to produce a vibration frequency, in the housing, of at least about 1,000 vibrations per minute, the vibrating tile setting tool, in operation, having a total mass of no more than 5 pounds, whereby the vibrating tile setting tool realizes a vibration frequency to mass ratio of at least about 200 vibrations per minute per pound mass. In some embodiments, the vibrating tile setting tool further comprises a cordless rechargeable DC power supply.

In some embodiments, the vibrating tile setting tool has a total mass of less than about 3 pounds.

In some embodiments, the vibrating tile setting tool has a total mass of less than about 1 pound.

In some embodiments, the vibration mechanism comprising a motor having an output shaft adapted and configured to rotate at at least about 1000 revolutions per minute In some embodiments, the housing defines a hand grip adapted and configured to be grasped by a user by applying a relatively flattened palm, and partially flexed fingers, of a user's generally open hand to the hand grip, and wherein the hand grip further provides a function of the housing associated with enclosing contained elements of the tile setting tool.

In some embodiments, the tile interface member has a bottom surface, the bottom surface having generally constant point-to-point surface elevations whereby generally the entirety of that projected portion of the bottom surface which faces a top surface of a tile is in contact with such tile when the tile setting tool is being used on such tile.

In some embodiments, the vibration mechanism vibrates at a frequency sufficiently high to substantially reduce viscosity of a tile setting mud at a tile-mud interface when the vibrating tile setting tool is set on such tile and energized.

In some embodiments, the vibrating tile setting tool, in operation, has a ratio of vibration frequency to total mass of at least 5000 vibrations per minute per pound mass, and wherein the vibration mechanism vibrates at a frequency sufficiently high to substantially reduce viscosity of a tile setting mud at a tile-mud interface when the vibrating tile setting tool is set on such tile and energized.

In some embodiments, the vibrating tile setting tool has a total mass of no more than about 1 pound.

In some embodiments, the vibrating tile setting tool, in operation, has a ratio of vibration frequency to total mass of at least 1000 vibrations per minute per pound mass.

In some embodiments, vibrating tile setting tool, in operation, has a ratio of vibration frequency to total mass of at least 5000 vibrations per minute per pound mass.

In some embodiments, the vibrating tile setting tool, in operation, has a ratio of vibration frequency to total mass of at least 7000 vibrations per minute per pound mass.

In a second family of embodiments, the invention comprehends a vibrating tile setting tool adapted and configured to interface with an upper surface of a tile, thereby to facilitate setting such tile in mud, the vibrating tile setting tool comprising a housing having a bottom wall, and at least one sidewall extending upwardly from the bottom wall the sidewall extending upwardly from the bottom wall, the side wall and the bottom wall, together, at least in part defining a housing cavity; a tile interface member; a vibration mechanism attached to the housing, a self-contained power supply disposed within the housing cavity; and a charging input mounted to the housing and communicating with the self-contained power supply, whereby the charging input is adapted and configured to facilitate energizing at least one of the vibration mechanism and the self-contained power supply.

In some embodiments, the self-contained power supply comprises a battery pack having battery chemistry selected from the group consisting of nickel-cadmium, nickel-metal hydride, lithium, lithium-ion, lead-acid, silver-zinc, zinc-carbon, alkaline, and zinc-air chemistries.

In some embodiments, the housing defines a hand grip adapted and configured to be grasped by a user by applying a relatively flattened palm, and partially flexed fingers, of a user's generally open hand to the hand grip, and wherein the hand grip further provides a function of the housing associated with enclosing contained elements of the tile setting tool.

In some embodiments, the vibration mechanism is actuated along a generally upright axis.

In some embodiments, the tile interface member has a bottom surface, the bottom surface having generally constant point-to-point surface elevations whereby generally the entirety of that projected portion of the bottom surface which faces a top surface of a tile is in contact with such tile when the tile setting tool is being used on such tile.

In a third family of embodiments, the invention comprehends a vibrating tile setting tool adapted and configured to interface with an upper surface of a tile, thereby to facilitate setting such tile in mud, the vibrating tile setting tool comprising: a housing having a bottom wall, at least one sidewall extending upwardly from the bottom wall; a vibration mechanism attached to the housing; and a tile interface member having a bottom interface surface, the bottom interface surface being adapted and configured to communicate with a tile to be set, the bottom interface surface, in a rest configuration, being generally planar, allowing for gravity-induced droop.

In a fourth family of embodiments, the invention comprehends a kit for installing tile comprising: a vibrating tile setting tool having a cordless DC power supply, tile adhesive, and a trowel.

In some embodiments, the vibrating tile setting tool in operation has a vibration frequency and a mass, such that a vibration frequency to mass ratio is at least 100 vibrations per minute per pound mass.

In some embodiments, the vibrating tile setting tool has a total mass of less than about 3 pounds.

In some embodiments, the vibrating tile setting tool has a total mass of no more than 1 pound.

In some embodiments, the vibrating tile setting tool vibrates at a frequency of at least 1000 vibrations per minute.

In some embodiments, the vibrating tile setting tool vibrates at a frequency of at least 5000 vibrations per minute.

In some embodiments, the vibrating tile setting tool comprises a tile interface member surface adapted and configured to communicate with a tile surface, the tile interface surface having generally constant point-to-point surface elevations whereby generally the entirety of that projected portion of the tile interface surface which faces a top surface of a tile is in contact with such tile when the tile setting tool is being used on such tile.

In some embodiments, vibrating tile setting tool comprises a vibration mechanism, and wherein the vibration mechanism vibrates at a frequency sufficiently high to substantially reduce viscosity of a tile setting mud at a tile-mud interface when the vibrating tile setting tool is set on such tile and energized.

In some embodiments, the vibrating tile setting tool has a total mass of no more than about 1 pound.

In some embodiments, the vibrating tile setting tool, in operation, has a ratio of vibration frequency to total mass of at least 200 vibrations per minute per pound mass.

In some embodiments, the vibrating tile setting tool, in operation, has a ratio of vibration frequency to total mass of at least 1000 vibrations per minute per pound mass.

In some embodiments, the vibrating tile setting tool, in operation, has a ratio of vibration frequency to total mass of at least 5000 vibrations per minute per pound mass.

In some embodiments, the vibrating tile setting tool, in operation, has a ratio of vibration frequency to total mass of at least 7000 vibrations per minute per pound mass.

In a fifth family of embodiments, the invention comprehends a method of installing tile using a vibrating tile setting tool having total mass of no more than 3 pounds, and a housing which generally encloses a vibrating mechanism, the tile setting tool further comprising a tile interface member in vibrational communication with the vibrating mechanism, the method comprising: applying an adhesive layer to a substrate suitable for affixing tile to such substrate; positioning a tile having first and second opposing surfaces on the adhesive layer such that the first tile surface is in face to face communication with the adhesive layer; energizing the tile setting tool, having total mass of no more than 3 pounds, and thereby causing the tile setting tool to vibrate, gripping the tile setting tool in a palm of a user's hand, and while so gripping the vibrating tile setting tool, positioning the vibrating tile setting tool in surface-to-surface communication with the second tile surface of the tile; and while so gripping the vibrating tile setting tool, manipulating the vibrating tile setting tool so as to move the tile laterally and/or vertically, under the influence of the vibration, so as to cooperatively position the tile relative to an array of such tile, the vibration of the tile setting tool being effective to facilitate moving, and thus setting, the tile.

In some embodiments, the method includes vibrating the vibrating tile setting tool at a vibration frequency of at least about 1,000 vibrations per minute.

In some embodiments, the method includes the vibrating tile setting tool comprising a rechargeable DC power supply which vibrates the tile setting tool at a vibration frequency to mass ratio of at least 3000 vibrations per minute.

In some embodiments, the method includes the vibrating tile setting tool comprising a rechargeable DC power supply which vibrates the tile setting tool at a vibration frequency to mass ratio of at least 5000 vibrations per minute.

In some embodiments, the method includes the vibrating tile setting tool comprising a rechargeable DC power supply which vibrates the tile setting tool at a vibration frequency to mass ratio of at least 7000 vibrations per minute.

In some embodiments, the method includes the vibrating tile setting tool comprising a rechargeable DC power supply which vibrates the tile setting tool at a vibration frequency to mass ratio of at least 1000 vibrations per minute per pound mass.

In some embodiments, the method includes wherein the vibrating tile setting tool has a total mass of no more than 1 pound, and the vibration frequency to mass ratio is at least about 5000 vibrations per minute per pound mass.

In some embodiments, the method includes wherein the vibrating tile setting tool has a total mass of no more than 1 pound, and the vibration frequency to mass ratio is at least about 7000 vibrations per minute per pound mass.

In some embodiments, the method includes wherein the tile setting tool vibrates at a frequency of at least about 5000 vibrations per minute.

In some embodiments, the method includes powering the vibrating tile setting tool with a rechargeable cordless power supply.

Figure 1:
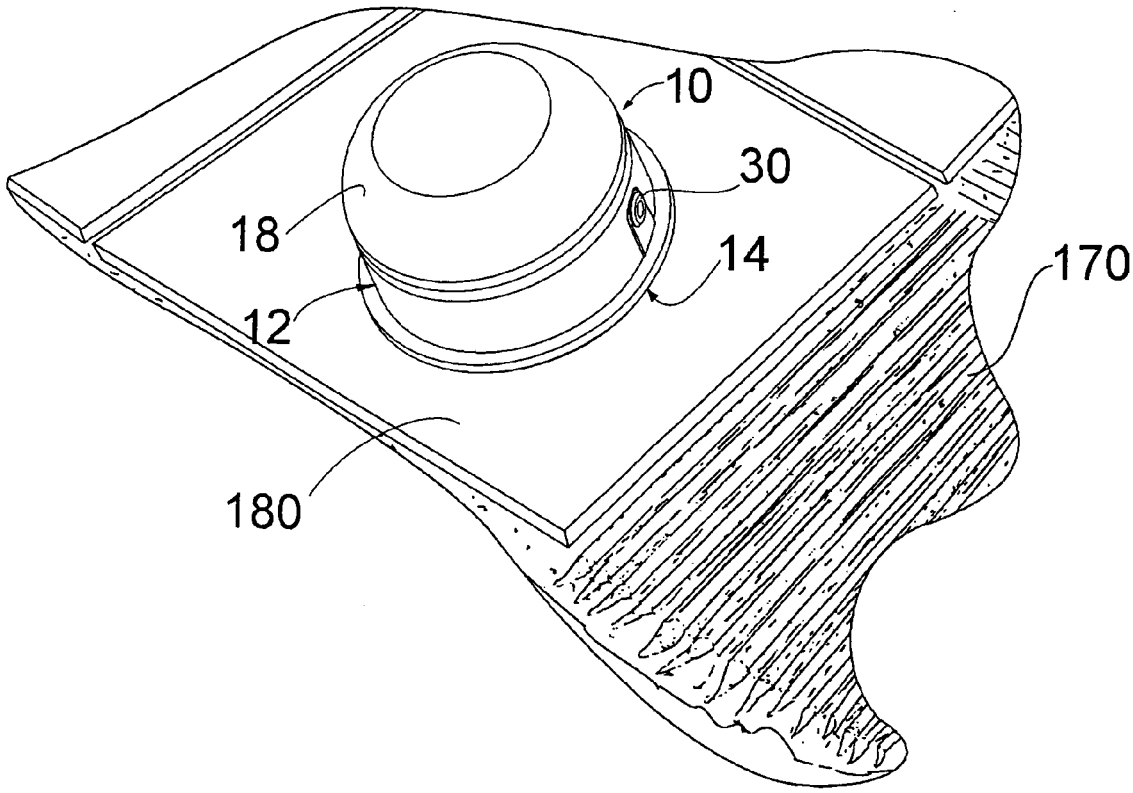
FIG. 1 shows a perspective view of a first embodiment of a vibrating tile setting tool of the present invention.

The invention is not limited in its application to the details of construction or the arrangement of the components set forth in the following description or illustrated in the drawings. The invention is capable of other embodiments or of being practiced or carried out in other various ways. Also, it is to be understood that the terminology and phraseology employed herein is for purpose of description and illustration and should not be regarded as limiting. Like reference numerals are used to indicate like components.

DESCRIPTION OF THE ILLUSTRATED EMBODIMENTS

Figure 2:
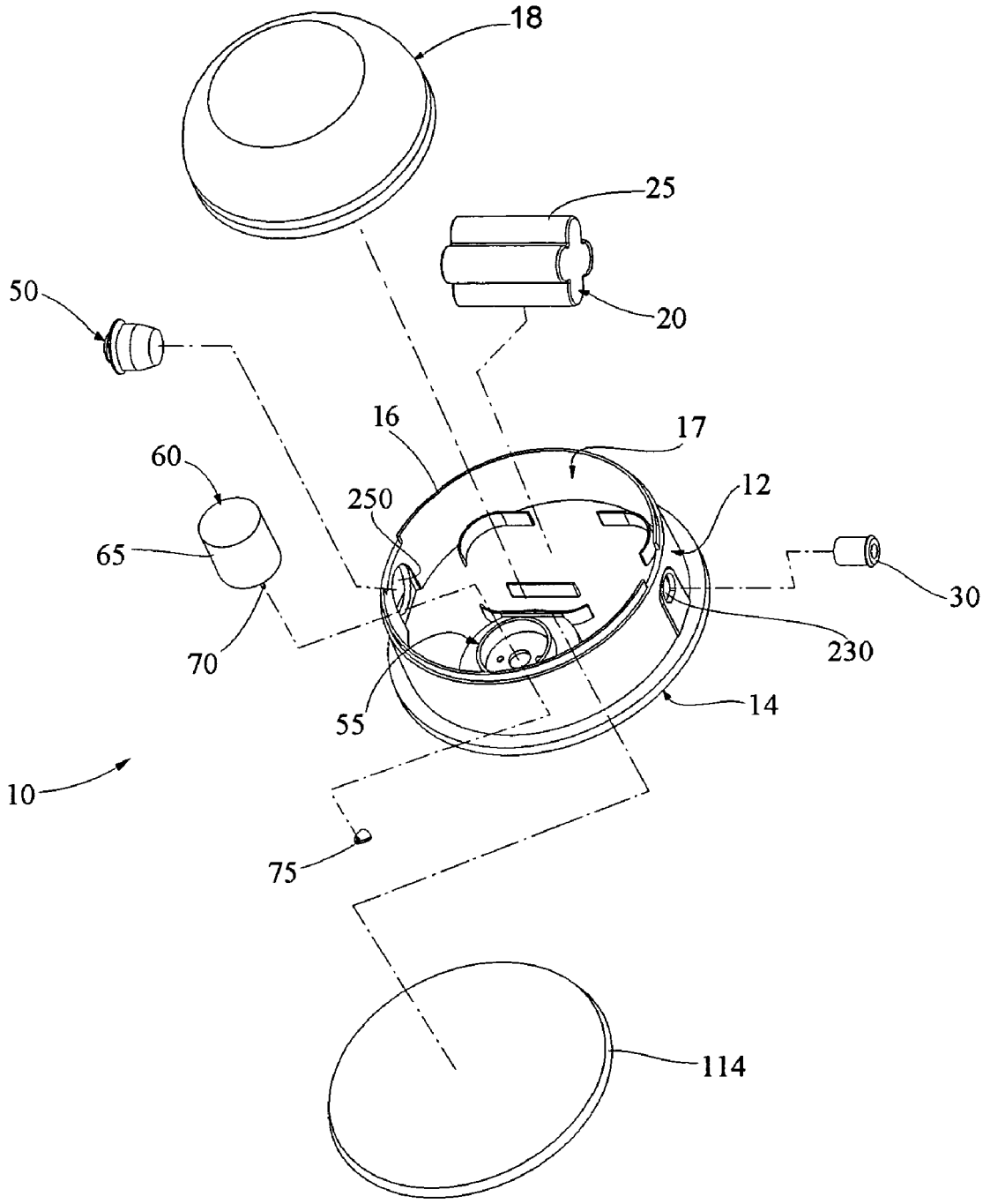
FIG. 2 shows an exploded view of the vibrating tile setting tool of FIG. 1.

Referring now to FIGS. 1 and 2, a vibrating tile setting tool 10 comprises housing 12, flange 14, housing lid 18, and tile interface member. Vibrating tile setting tool 10 is adapted and configured to vibratingly communicate with tile 180 and thereby to obtain an enhancement of bonding adhesion between tile 180 and adhesive 170.

As is described in greater detail hereinafter, a user generally causes vibrating tile setting tool 10 to vibratingly communicate with tile 180 by using switch assembly 50 to electrically connect power supply 20 with vibration mechanism 60, which in turn energizes the vibration mechanism and thus causes vibrating tile setting tool 10, and correspondingly tile interface member (FIG. 2) to vibrate. In applying the vibrating tile setting tool, the user places the vibrating tile setting tool on the surface of the tile 180 until the desired result, e.g. the tile becomes sufficiently set and/or level in the adhesive, is achieved.

One embodiment of vibrating tile setting tools 10 of the present invention is shown in exploded detail in FIG. 2. The vibrating tile setting tool 10 includes the housing 12 having upstanding sidewall 16 which generally defines a housing cavity 17. Power supply 20 and vibration mechanism housing 55 are accommodated, e.g. generally housed, held, or otherwise located in housing cavity 17. Vibration mechanism housing 55 generally holds vibration mechanism 60, which includes e.g. motor 65, output shaft 70, and weight 75 (FIG. 14), and is in turn at least partially accommodated within housing cavity 17.

Charging input 30, and switch assembly 50 extend inwardly into cavity 17 through apertures 230, 250, which extend through sidewall 16, respectively. Accordingly, at least part of charging input 30 and switch assembly 50 are accommodated inside housing cavity 17.

Bottom housing wall 12B (FIGS. 8 and 13) extends generally across the bottom of cavity 17, at the bottom of side wall 16. Flange 14 communicates with, and extends outwardly from, the bottom of side wall 16, as well as communicating with bottom housing wall 12B. Interface member 114 communicates with bottom wall 12B and flange 14, and provides at least part of the mechanical structure through which vibrating tile setting tool 10 can interact, directly or indirectly, with a workpiece e.g. tile 180 (FIG. 1).

Housing lid 18 is positioned generally opposite interface member 114 and bottom wall 12B, e.g. generally atop housing 12. Housing lid 18 generally spans across substantially the entire opening which extends into housing cavity 17, as defined by sidewall 16, and is thus adapted and configured to substantially cover, close, and/or seal housing cavity 17 (and components accommodated therein) from exposure to e.g. elements of the ambient environment which are outside vibrating tile setting tool 10.

Figure 3:
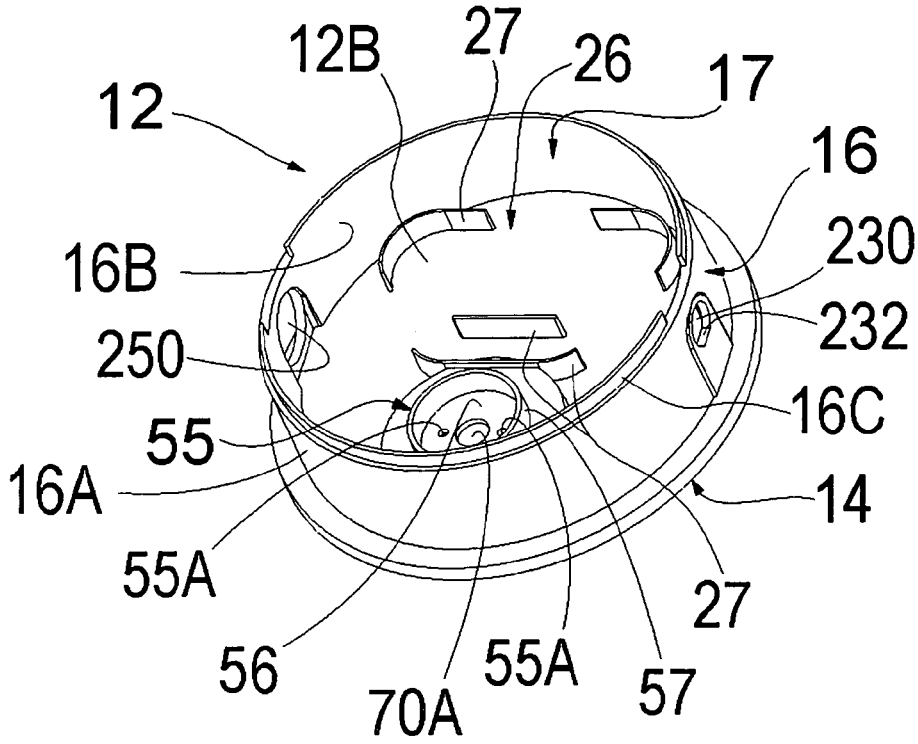
FIG. 3 shows a detailed perspective view of a housing of the vibrating tile setting tool illustrated in FIGS. 1 and 2.
Figure 13:
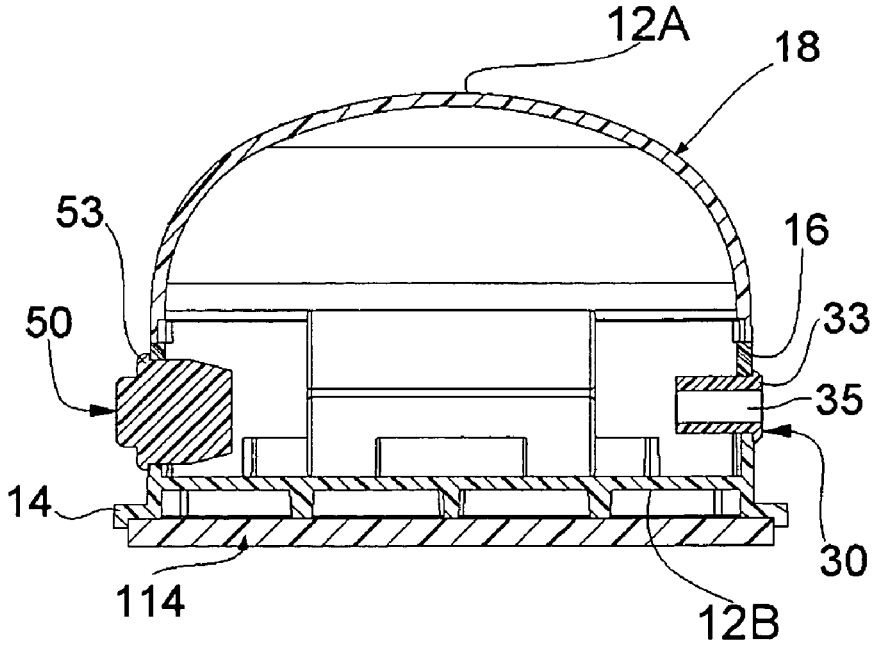
FIG. 13 shows a cross-sectional view of the vibrating tile setting tool of FIG. 1 taken at FIG. 13-FIG. 13 of FIG. 12.
Figure 14:
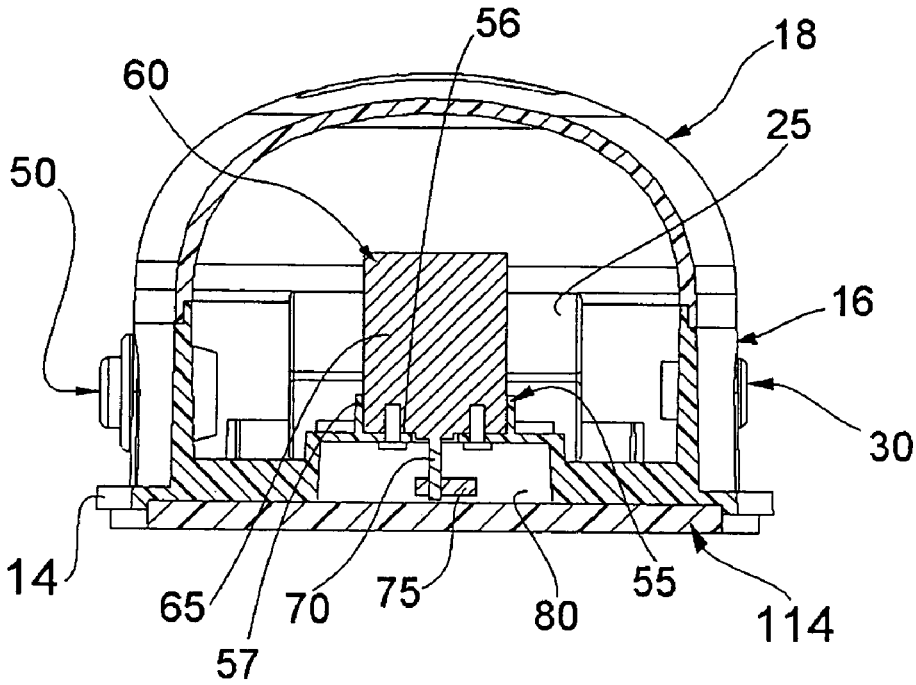
FIG. 14 shows a cross-sectional view of the vibrating tile setting tool of FIG. 1 taken at FIG. 14-FIG. 14 of FIG. 12.
Figure 15:
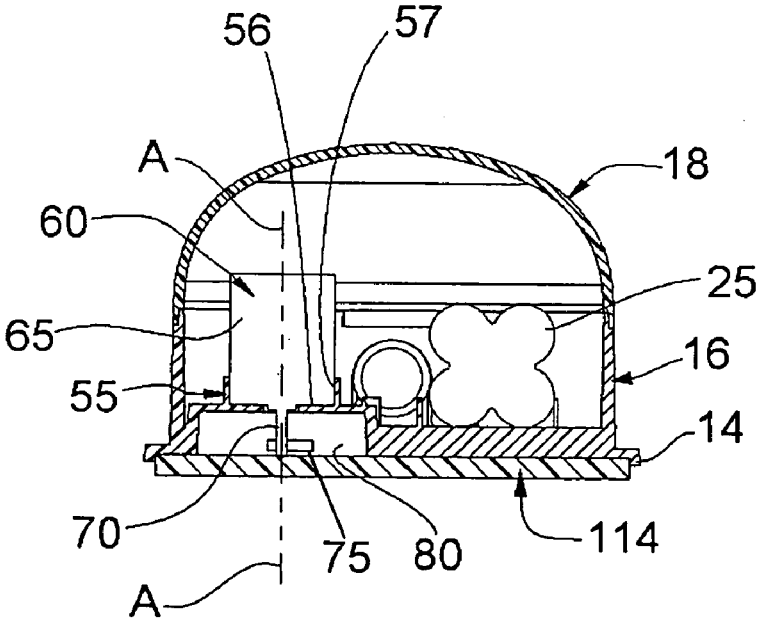
FIG. 15 shows a cross-sectional view of the vibrating tile setting tool of FIG. 1 taken at FIG. 15-FIG. 15 of FIG. 12.

Referring now to FIG. 3, housing 12 includes the above-mentioned bottom housing wall 12B which is generally planar and has an upper surface and a lower surface and an outer perimeter. Flange 14 extends generally radially outwardly from the bottom of side wall 16 and defines a flange opening adapted and configured to receive interface member 114 (FIGS. 2, 9, and 13) therein and to provide e.g. lateral support to at least part of the thickness of interface member 114 (FIGS. 13, 14, 15).

Sidewall 16 is attached to, and projects upwardly and away from, the upper surface of bottom housing wall 12B. Correspondingly, bottom wall 12B is integral with side wall 16 adjacent the bottom of the side wall, and extends inwardly from the side wall. Sidewall 16 has an outer sidewall surface 16A, which faces outwardly of cavity 17, and an inner sidewall surface 16B which faces inwardly into cavity 17. Surfaces 16A and 16B thus generally face in opposite directions.

Outer sidewall surface 16A faces generally radially outwardly from housing 12, while inner sidewall surface 16B faces generally radially inwardly from housing 12. Apertures 230 and 250 each have an aperture surface facing into the respective aperture. Each aperture surface extends from outer sidewall surface 16A to inner sidewall surface 16B and thus extends through sidewall 16, and is adapted and configured to accept charging input 30 (FIGS. 2, 5) or switch assembly 50 (FIGS. 2, 6) respectively. The aperture surface corresponding to aperture 230 further includes a flat surface 232 which is adapted and configured to cooperate with corresponding structure on e.g. charging input 30.

Lip 16C of sidewall 16 is a projection which extends upwardly from an upper portion of sidewall 16 and extends along at least a portion of the circumference of sidewall 16. Bottom housing wall 12B and inner sidewall surface 16B generally define housing cavity 17, which extends inwardly into housing 12.

Figure 10:
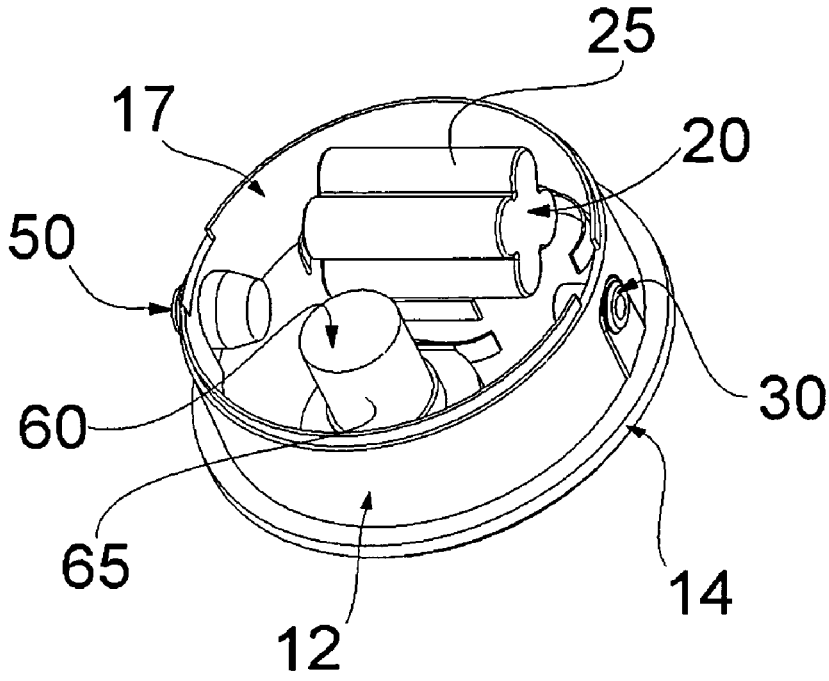
FIG. 10 shows a perspective view of the vibrating tile setting tool of FIG. 1, with the lid removed.
Figure 11:
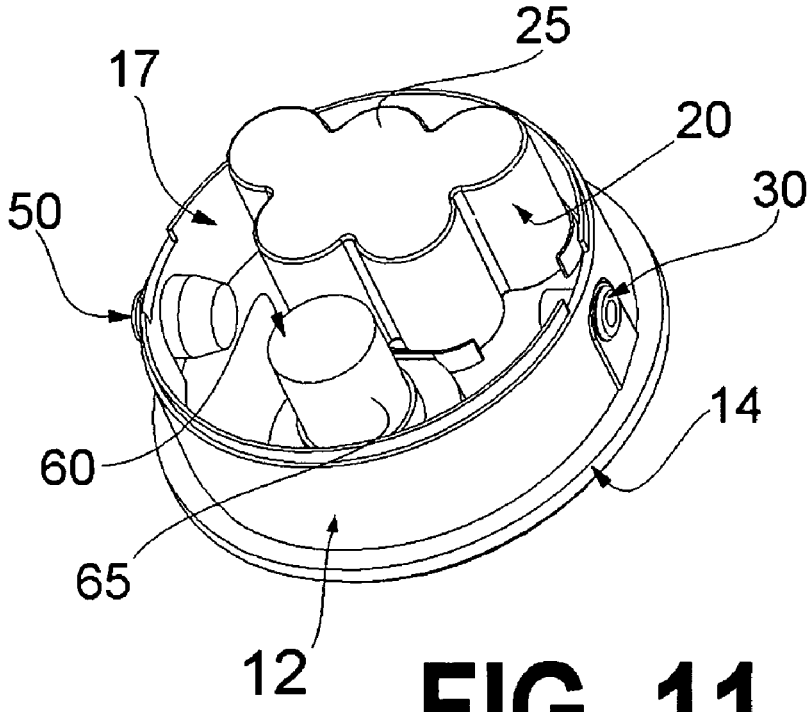
FIG. 11 shows a perspective view of a second embodiment of a vibrating tile setting tool of the invention, with the lid removed.
Figure 12:
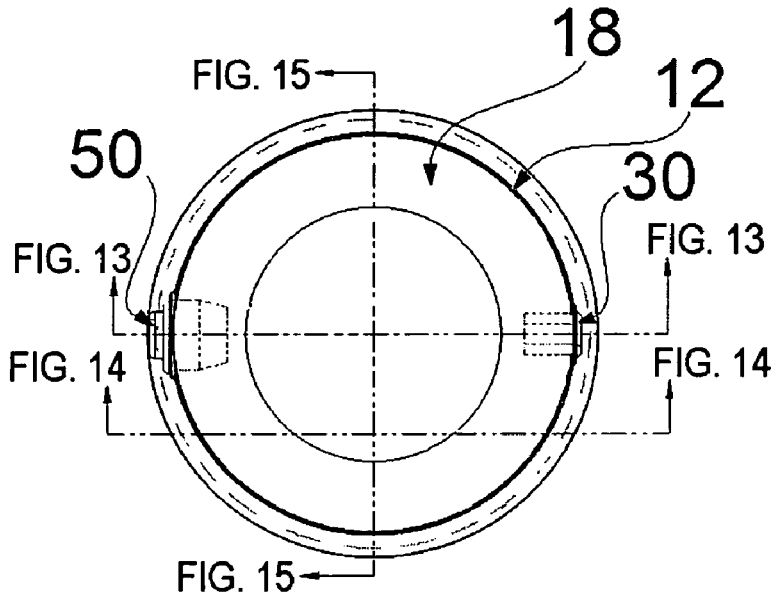
FIG. 12 shows a top elevation view of the vibrating tile setting tool of FIG. 1.

Battery holder 26 communicates with the upper surface of bottom housing wall 12B, and generally resides in housing cavity 17. Battery holder 26 includes at least one finger 27, and preferably a plurality of fingers 27, adapted and configured to resiliently hold a battery, e.g. battery pack 25 (FIGS. 2, 10, and 11).

Vibration mechanism housing 55 extends upwardly from the upper surface of bottom housing wall 12B, is integral with bottom wall 12B and sidewall 16, and generally resides in housing cavity 17. Housing 55 is adapted and configured to receive e.g. vibration mechanism 60 therein. Vibration mechanism housing 55 includes a bottom wall 56 and a retainer lip 57 extending upwardly from bottom wall 56. The retainer lip generally defines a perimeter of housing 55 of the upwardly open vibration mechanism housing 12. Mounting apertures 55A and shaft aperture 70A extend through bottom wall 56 and are adapted and configured to cooperate with corresponding structures of vibration mechanism 60.

Figure 8:
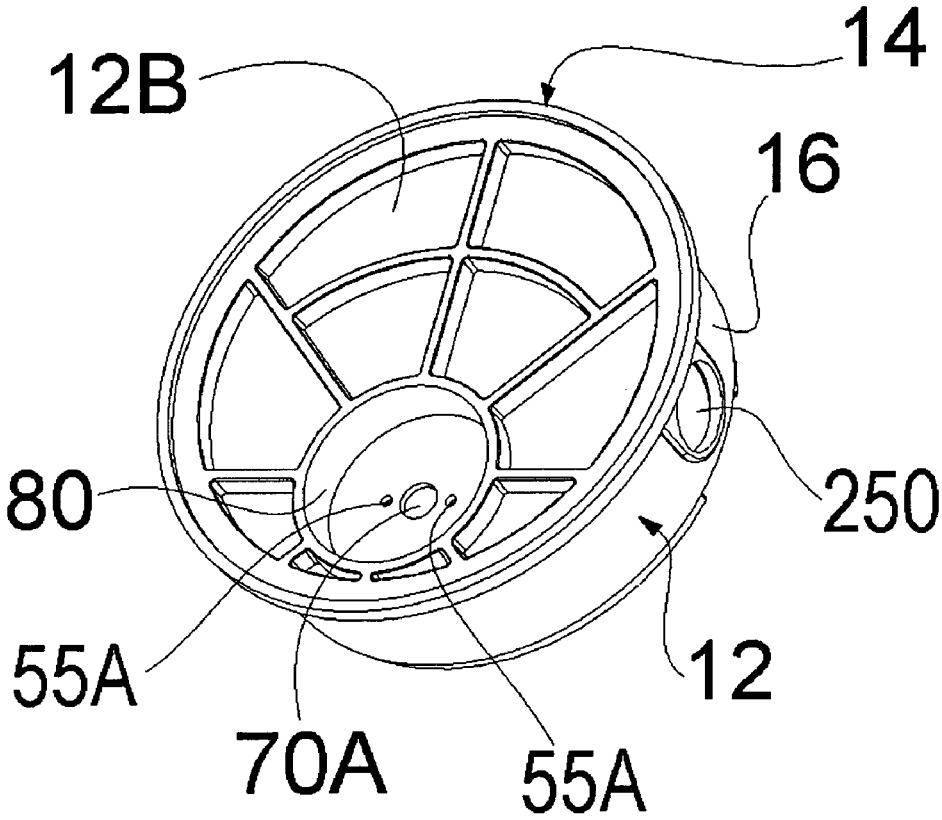
FIG. 8 shows a bottom perspective view of a housing of the vibrating tile setting tool illustrated in FIG. 3.

Vibration mechanism housing 55 is positioned generally above a vibration cavity 80 (FIGS. 8, 14, and 15). Cavity 80 defines a diameter which is coaxial with, and of greater magnitude than, the magnitude of the diameter of the vibration mechanism housing. The bottom wall of vibration mechanism housing 55 and/or bottom housing wall 12B generally physically separate the vibration mechanism housing 55 from vibration cavity 80. Each of mounting apertures 55A and shaft aperture 70A extend between, and correspondingly generally define a through bore between, vibration mechanism housing 55 and vibration cavity 80.

Figure 4:
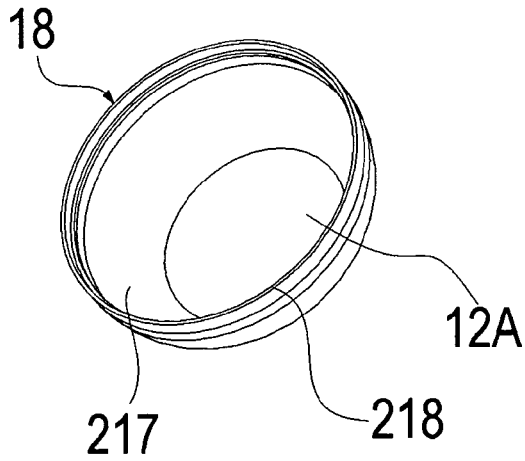
FIG. 4 shows a detailed perspective view of a lid of the vibrating tile setting tool illustrated in FIGS. 1 and 2.

Referring now to FIG. 4, housing lid 18 includes an outer perimeter defined by rim 218 at one end of the housing lid and is adapted and configured to cooperate with lip 16C, enabling housing lid 18 to be removably attached to housing 12. The other, opposite, end of housing lid 18 realizes a generally closed surface e.g. top housing wall 12A. Housing lid 18 has at least one wall which extends from rim 218 to top housing wall 12A. The at least one wall and top housing wall 12A generally define a concavity, relative rim 218, e.g. housing lid cavity 217. Top and side walls of lid 18 are so configured as to facilitate the installer using the lid as a hand grip for lifting tool 10 and manipulating tool 10 in the process of setting a tile. When housing lid 18 is removably attached to housing 12, housing cavity 17 and housing lid cavity 217 communicate and collectively define a generally unitary cavity within vibrating tile setting tool 10.

Referring now to FIGS. 2, 10, and 11, power supply 20 includes battery pack 25, charging input 30, and e.g. a battery charger (not shown), as well as appropriate electrical connections connecting the respective elements. Battery pack 25 generally has a battery length dimension, a battery width dimension, and a battery height dimension. Battery pack 25 comprises e.g. at least one cell arranged generally horizontally relative to bottom housing wall 12B (FIGS. 2, 10, 13, 14, and 15), alternatively generally vertically relative to bottom housing wall 12B (FIG. 11).

Each of the at least one cell of battery pack 25 is adapted and configured to utilize electrochemical reactions to produce electrical energy, preferably in rechargeable format. Those skilled in the art of batteries are well aware of suitable battery chemistries, including rechargeable battery chemistries for producing electrical energy, including but not limited to nickel-cadmium, nickel-metal hydride, lithium, lithium-ion, lead-acid, silver-zinc, carbon-zinc, zinc-air, various alkaline battery chemistries, zinc-air, and others. In some embodiments, battery pack 25 produces a voltage of about 6 volts, alternatively 3 volts or less e.g. 1.5 volts or 3 volts, alternatively 9 volts or more e.g. 9 volts, 12 volts, 18 volts, 24 volts, or more.

Figure 5:
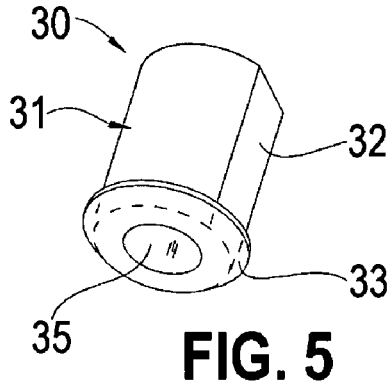
FIG. 5 shows a detailed perspective view of a charging input of the vibrating tile setting tool illustrated in FIGS. 1 and 2.

Referring now to FIG. 5, charging input 30 includes input body 31, flat side 32, input shoulder 33, input receptacle 35, and first and second opposing terminal ends. Input body 31 is a generally cylindrical elongate body, having a length, an outer surface, and an outer circumference.

Flat side 32 is a generally planar surface which extends along a major portion of the length of, and defines at least a portion of the outer surface of, input body 31 and is adapted and configured to cooperate with corresponding flat surface 232 (FIG. 3) of aperture 230 which extends through sidewall 16.

Input receptacle 35 includes a bore which extends longitudinally into and/or through charging input 30. The bore of input receptacle 35 is adapted and configured to receive, e.g. a plug of a battery charger and/or AC adapter therein. Input receptacle 35 further includes at least one e.g. metallic electrical contact to realize a combination mechanical and electrical interface between input receptacle 35 and such battery charger and/or AC adapter enabling such charger or AC adapter to be in electrical communication with vibrating tile setting tool 10.

Those skilled in the art are well aware of suitable battery chargers and/or AC adapters capable of transforming a relatively higher AC voltage, e.g. 110/120 VAC to a relatively lower DC voltage, e.g. 1.5 VDC, 3 VDC, 6 VDC, 9 VDC, 12 VDC, 14 VDC, 16 VDC, 18 VDC, 24 VDC, or other such relatively lower DC voltages, suitable for energizing vibrating tile setting tool 10 and/or recharging battery pack 25. Such battery charger and/or AC adapter has first and second ends and includes, adjacent the first end, a wall plug which can be inserted into e.g. a wall power outlet. The second end includes a plug which is adapted and configured to be inserted into input receptacle 35 of charging input 30 thereby to connect tile setting tool 10 to the national power grid.

Figure 6:
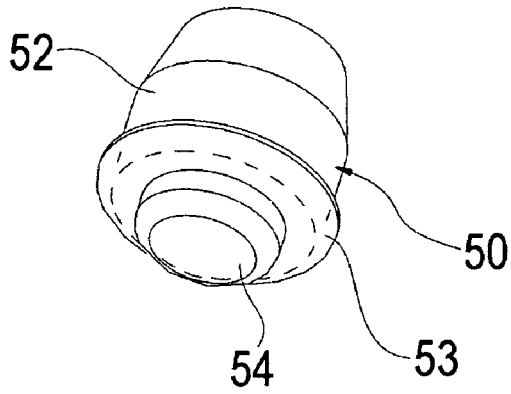
FIG. 6 shows a detailed perspective view of a switch of the vibrating tile setting tool illustrated in FIGS. 1 and 2.
Figure 7:
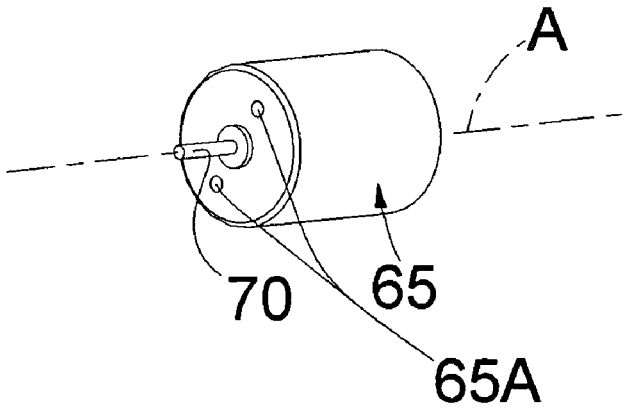
FIG. 7 shows a detailed perspective view of a motor of the vibrating tile setting tool illustrated in FIG. 2.

Referring now to FIG. 6, switch assembly 50 includes switch body 52, switch shoulder 53, button 54, and first and second terminal ends. Switch body 52 is a generally cylindrical elongate body, having a length, an outer surface, and an outer diameter.

The outer surface of switch body 52 is adapted and configured to communicate with an outermost perimeter of aperture 250 which extends through sidewall 16 (FIG. 3). Switch assembly 50 has first and second terminals which connect switch assembly 50 into an electrical circuit which is used to pass electrical energy from battery pack 25 to motor 65.

Referring now to FIGS. 2, 7, 14, and 15, vibration mechanism 60 includes motor 65 output shaft 70, and weight 75. Motor 65 has a generally cylindrical body, and first and second terminal ends which generally define a length therebetween. Motor 65 further has an output shaft 70 extending outwardly from the first terminal end. The first terminal end is generally planar and circular and has a plurality of apertures extending therethrough, including mounting apertures 65A, and a shaft aperture (not labeled) through which output shaft 70 extends.

Motor 65 and output shaft 70 are preferably adapted and configured so that when motor 65 is energized, output shaft 70 rotates about an axis of rotation "A" at a rotational speed of at least about 1,000 revolutions per minute (RPM), optionally at least about 5,000 RPM, and preferably at least about 7,000 RPM e.g. at least about 7,800 RPM and up to about 15,000 RPM.

In preferred embodiments, weight 75 is directly attached to output shaft 70 and correspondingly when motor 65 is energized, weight 75 rotates about an axis of rotation, which is generally coaxial with the axis of rotation "A" of output shaft 70, at a rotational speed corresponding to the speed of rotation of output shaft 70, namely at least about 1,000 RPM, optionally at least about 5,000 RPM, and preferably at least about 7,000 RPM e.g. at least about 7,800 RPM.

Weight 75 includes a body having a mass, a center of mass at a defined locus, and a bore which extends through the body. The bore is adapted and configured to accept output shaft 70 therein, enabling weight 75 to be attached to motor 65 by conventional means such as by using mechanical fasteners, press-fitting, keying, welding, adhering, or by other well known means of attachment.

The bore which extends through weight 75 is at a locus separate and distinct from the locus of the center of mass of weight 75, e.g. "off-center" from the center of mass of the weight, whereby rotation of weight 75 about its bore is a generally unbalanced rotation. With vibration mechanism 60 mounted in housing 12, such unbalanced rotation of weight 75 at appropriate speeds causes housing 12, and thus the entire tool 10, to vibrate.

Figure 9:
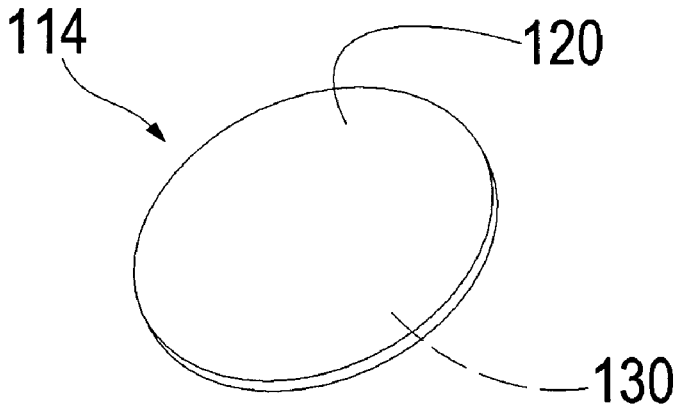
FIG. 9 shows a detailed perspective view of an interface of the vibrating tile setting tool illustrated in FIGS. 1 and 2.

Referring now to FIGS. 2 and 9, interface member 114 has top and bottom surfaces, e.g. top interface surface 120 and bottom interface surface 130 respectively, and an outer perimeter (not labeled). Top interface surface 120 of the interface member communicates with bottom housing wall 12B of housing 12 and is adapted and configured to be attached to bottom housing wall 12B. Those skilled in the art are well aware of methods and materials suitable to attach bottom housing wall 12B and interface member 114 to each other including, but not limited to, adhesives, plastic welding, mechanical fasteners e.g. screws, bolts, rivets, and others.

Bottom surface 130 of interface member 114 is adapted and configured to communicate with a workpiece e.g. tile 180 and preferably comprises a resilient material. Those skilled in the art are well aware of suitable resilient materials to interface with tiles which include, but are not limited to, various ones of the solid polymeric materials including rubbers, various foams, and/or others. Bottom surface 130 is preferably planar, in order to easily interface with the top surface of a tile which has a substantially flat top, and which is to be set. Such e.g. planar configuration is, of course, accommodative of gravity-induced droop characteristics of the material from which the tile interface member is made.

Where it is contemplated that top surfaces of tiles to be set have other than flat configurations, bottom surface 130 can be configured to conform to such other than flat top surface configurations. However, in any case, it is preferred that bottom surface be so configured that, when bottom surface 130 is resting on such tile top surface, and ready to set the tile, at least 50 percent of the projected bottom surface of the interface member is in contact with the top surface of the tile.

To that end, the installer can change out, replace tile interface member whenever the installer encounters a tile having a top surface configuration which is substantially different from the bottom surface configuration of the interface member.

In the alternative, the tile interface member can be fabricated with materials whereby bottom surface 130 is sufficiently pliable, soft, and deflectable, to conform to a wide variety of top surface configurations of the tiles, while tile interface member is also sufficiently hard, rigid to transfer vibrations from tool 10 to the tile, effective to activate the beneficial effects of the vibrations.

In general, bottom surface 130 has a generally continuous contact surface, having generally constant point-to-point surface elevations, whereby generally the entirety of that projected portion of bottom surface 130, which faces the top of a tile, is in contact with the tile when tool 10 is being used on that tile.

Referring now to FIGS. 2, 3, 4, 14, and 15, housing 12 and housing lid 18 have corresponding structures which enable housing lid 18 to be removably attached to housing 12. Lip 16C (FIG. 3) has an outwardly facing surface which faces generally outwardly from housing 12, and comprises preferably, a resilient polymeric material which enables lip 16C to generally resist and bias outwardly against e.g. an inwardly directed force such as a force applied generally inwardly toward cavity 17 of housing 12.

Rim 218 (FIG. 4) has an inwardly facing surface which faces generally inwardly toward housing lid cavity 217. Rim 218 is adapted and configured to intimately communicate with lip 16C, e.g. the inwardly facing surface of rim 218 and the outwardly facing surface of lip 16C realize a face-to-face relationship when lid 18 is attached to housing 12 (FIGS. 14, 15).

Rim 218 is generally rigid enough so that when lid 18 is attached to housing 12, the communication between rim 218 and lip 16C realizes an inwardly directed force from rim 218 against lip 16C, generally in the direction of cavity 17. Correspondingly, lip 16C generally resists such inwardly directed force and tends to bias outwardly against such force and thus against rim 218, whereby a friction fit is realized between lip 16C and rim 218 which removably mounts lid 18 to housing 12. When a user desires to remove lid 18 from housing 12, the user applies a generally upward force to lid 18 of sufficient magnitude to overcome the force of the friction fit between lip 16C and rim 218.

Referring now to FIGS. 2, 3, 14, and 15, battery holder 26 is adapted and configured to resiliently/grippingly hold battery pack 25 therein. Ones of fingers 27 (FIG. 3) each have an inwardly facing surface which faces generally inwardly of battery holder 26 and thus inwardly of housing 12, and comprises typically, a resilient polymeric material which enables each of fingers 27 to generally resist and bias inwardly against e.g. an outwardly directed force such as a force applied generally outwardly of battery holder 26 and thus outwardly of housing 12.

Battery pack 25 has an outer surface defined by a perimeter which corresponds to the battery length dimension and a width dimension of the battery pack. The battery pack length dimension, and corresponding battery pack width dimension respectively correspond to distances between corresponding ones of fingers 27, enabling battery pack 25 to intimately communicate with battery holder 26, e.g. the outer surface of battery pack 25 collectively realize a surface-to-surface relationship with the battery holder when battery pack 25 is being held in battery holder 26 (FIGS. 14, 15).

Battery pack 25 is generally so sized, and is so rigid, that when battery pack 25 is held in battery holder 26, the communication between battery pack 25 and ones of fingers 27 realizes an outwardly directed force from battery pack 25 against ones of fingers 27, generally in the direction outwardly away from battery holder 26. Correspondingly, ones of fingers 27 generally resist such outwardly force and tend to bias inwardly against such force and thus against battery pack 25, whereby a friction fit is realized between battery pack 25 and respective ones of fingers 27. The friction fit between battery pack 25 and respective ones of fingers 27 provides a gripping force sufficiently strong to enable battery pack 25 to be securely and resiliently/grippingly held in battery holder 26, and preferably to be removably resiliently/grippingly held in battery holder 26.

Referring now to FIGS. 2, 3, 5, 12, 13, and 14, charging input 30 is adapted and configured to be slidingly received into aperture 230, which extends through sidewall 16 of housing 12. Corresponding structures on charging input 30 and aperture 230 cooperate to realize a generally secure mounting of charging input 30 to housing 12.

Referring now to FIGS. 2, 3, 7, 8, 14, and 15, vibration mechanism 60 is mounted to housing 12, via housing 55, so as to enable a vibratory force to be transferred from vibration mechanism 60, through housing 12, through interface member 114, and to a workpiece, e.g. tile 180. The mounting of vibration mechanism 60 to housing 12 is represented by the mounting of motor 65 to vibration mechanism housing 55. Housing 55 conveys the vibrations of the vibration mechanism to housing 12, which conveys the vibration to interface member 114. Interface member 114 conveys the vibrations to the work piece/tile.

The upper surface of the bottom wall of vibration mechanism housing 55 interfaces with the generally planar end of motor 65, and generally vertically supports the mass of motor 65. The inner surface of the retainer lip 57, which is extends upwardly from bottom wall 56, communicates with the outer surface of, and extends at least partially along the length of, motor 65 enabling the retainer lip to provide lateral support to motor 65 (FIGS. 10, 11, 14, and 15).

Respective ones of mounting apertures 55A which extend through the bottom wall of vibration mechanism housing 55, and mounting apertures 65A which extend through the generally planar end of motor 65 are generally coaxially aligned with each other.

The generally coaxial alignment relationship between respective mounting apertures 55A and 65A enables mounting hardware 58, e.g. screws, bolts, and/or other mounting hardware, to extend through apertures 55A and into 65A in series and correspondingly mechanically to connect vibration mechanism housing 55 and motor 65 to each other.

Output shaft 70 extends downwardly from motor 65, through shaft aperture 70A, e.g. through the bottom wall 56 of vibration mechanism housing 55, and into vibration cavity 80 (FIGS. 14 and 15). Weight 75 is attached to output shaft 70 below the lower surface of the bottom wall of vibration mechanism housing 55, e.g. is attached to output shaft 70 generally within vibration cavity 80, at the bore in weight 75, which is substantially displaced from the center of mass of weight 75. Thus, weight 75, and part of shaft 70, are in vibration cavity 80, with the center of gravity of the weight offset from center of rotation of the weight.

Ones of power supply 20, charging input 30, switch assembly 50, and vibration mechanism 60 are e.g. electrically connected to other ones of power supply 20, charging input 30, switch assembly 50, and vibration mechanism 60, by appropriate electrical circuitry, so as to (i) enable a user to energize vibration mechanism 60 by e.g. depressing button 54 of switch assembly 50 and thereby closing the electrical circuit within vibrating tile setting tool 10, and/or to (ii) charge power supply 20 by e.g. inserting a plug of a battery charger and/or AC adapter into charging input 30.

Those skilled in the art are well aware of suitable electrical supplies/components and methods of using such supplies/components to effectuate such electrical connections between ones of power supply 20, charging input 30, switch assembly 50, and vibration mechanism 60 to enable a user to energize vibration mechanism 60, including but not limited to electrical wire, latex tape, friction tape, plastic electrical tape, solder, conventional electrical connectors, and others.

When motor 65 is energized, output shaft 70 rotates, correspondingly rotating offset weight 75 about axis "A" of shaft 70. At least part of output shaft 70 and weight 75 rotate within vibration cavity 80, whereby the off-set mounting of weight 75 on output shaft 70 causes a generally rotatably unbalanced condition whereby rotation of shaft 70 imparts a vibration to/through e.g. motor 65, thence to vibration mechanism 60.

The vibration imparted through vibration mechanism 60 is transferred through mounting hardware 58 and housing 55 to bottom housing wall 12B, thence through interface member 114, and thence to the work piece e.g. tile 180.

Because weight 75 is connected directly to output shaft 70, vibration mechanism 60 realizes a vibration frequency which corresponds to the rotational speed of output shaft 70. Thus, reflecting on the speed of rotation of shaft 70, vibration mechanism 60 vibrates at a vibration frequency of at least about 1,000 vibrations per minute (VPM), optionally at least about 5,000 VPM, and preferably at least about 7,000 VPM e.g. at least about 7,800 VPM or more, where one vibration corresponds to a full 360 degrees of rotation of shaft 70. Vibrating tile setting tool 10 has a total mass, in operation, of no more than about 7 pounds, alternatively a total mass of at most about 5 pounds. In some embodiments, vibrating tile setting tool 10 has a total mass of less than about 3 pounds and preferably less than about 1 pound, e.g. about 14 ounces (0.88 pound) or less. The lower the total mass, the higher is the vibration frequency which can be effectively transferred to the tile, and thence to the mud.

In some embodiments, vibrating tile setting tool 10 further includes at least one component which enables a user to monitor the relative state of "level" of a workpiece e.g. tile 180. Suitable components include but are not limited to levels, e.g. bubble levels, which are preferably mounted to vibrating tile setting tool 10 so as to be conspicuously displayed during use of vibrating tile setting tool 10, e.g. mounted to at least one of housing 12, flange 14, sidewall 16, housing lid 18, and elsewhere. Such level device is aligned with the bottom surface 130 of interface member 114.

Figure 16:
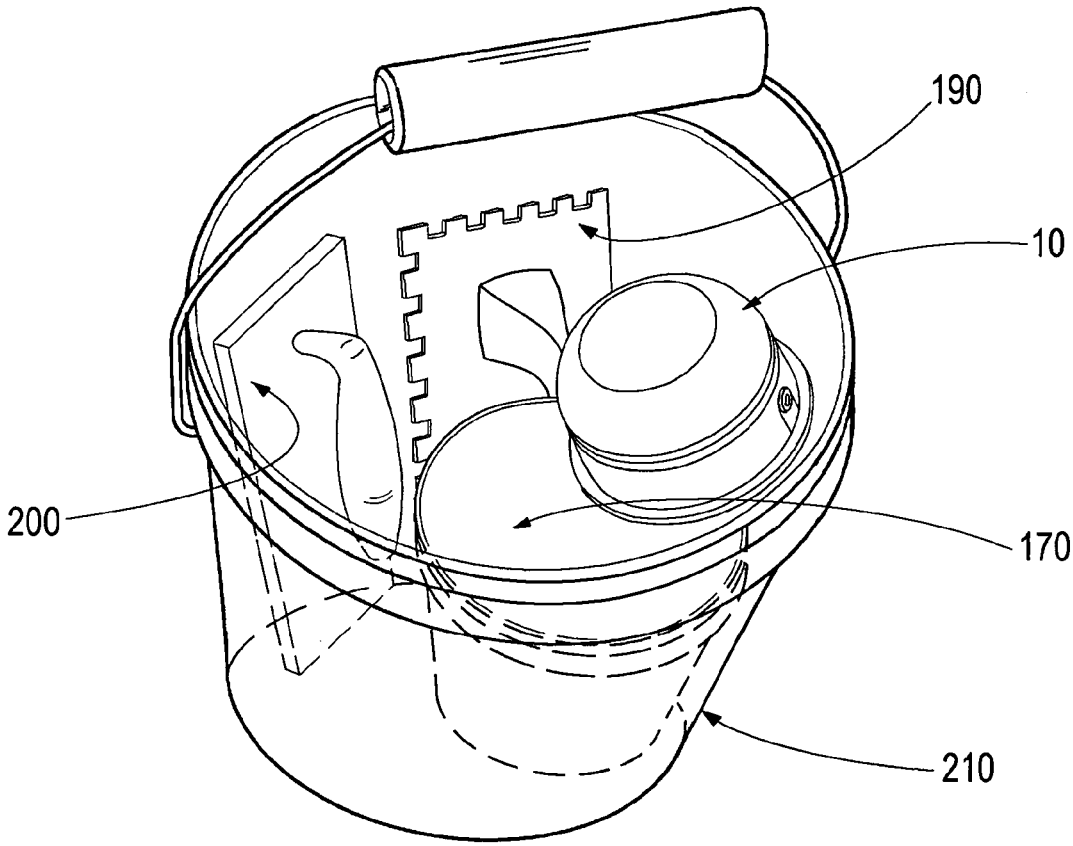
FIG. 16 shows a perspective view of a tile setting kit of the present invention having the vibrating tile setting tool of FIG. 1.

In the alternative, a lid 18 can incorporate a flat top surface, parallel to interface member 114 in the fully assembled tool. Such flat surface can then be used to receive an ordinary carpenter's level in order to check the "level" condition of the tile being set. In such case, the lid must be properly seated relative to housing 12, especially at lip 16C, in order for the flat surface on the lid to be parallel to interface member 114. Referring now to FIG. 16, the invention also comprehends e.g. a kit which includes vibrating tile setting tool 10 and one or more tools and/or accessories suitably and typically used by those skilled in the art in the tile installation process. Such one or more tools and/or accessories include but are not limited to a bucket 210, a grout float 200, a trowel 190, an adhesive 170, a sealer (not shown) and optionally others.

To use such kit, a user generally performs various procedures including but not limited to various preliminary preparation steps, adhesion of the tiles 180 to the floor, and finish work. Specifically, the user prepares the floor or sub-floor, by installing plywood, cement backer-board, or other sufficiently rigid building material, as a substrate over the existing floor or sub-floor or wall, as necessary. Optionally, the user installs a layer of roofing felt and/or a wire mesh e.g. directly over the substrate such as plywood or cement backer-board.

Once the substrate has been adequately prepared, the user determines the specific proposed tile layout and can correspondingly draw reference and/or layout lines to aid in subsequent tile placement. Typically, at least one row of tiles 180 is test-fitted against the reference line/lines to enable the user to visually inspect the proposed tile layout. As one example of a visual inspection, the user checks to confirm that full tiles 180 are placed in a relatively more visible part of the room while tiles 180 requiring cutting are placed in a relatively less visible part of the room.

The user then prepares an adhesive 170 to apply onto the substrate. Some adhesives 170 e.g. thinset require a mixture application procedure. As one example, the user combines an appropriate amount of water and an appropriate amount of a suitable thinset mix, and mixes the combination in e.g. a bucket to achieve the desired consistency/characteristic. Other suitable adhesives 170 or "muds" are well known to those skilled in the art, which may or may not require mixing with water, including various mortars, mastics, or other adhesives 170.

The user then applies the adhesive 170 onto the substrate as an adhesive layer (FIG. 1). Typically, the adhesive layer is applied in multiple applications to the substrate. Each adhesive application covers less than the entire surface area of the substrate. The ideal adhesive 170 application coverage area of each adhesive 170 application corresponds to no more than the amount of tile 180 the user can lay before the adhesive 170 dries to a non-desired, less adhesively effective state.

Each of the adhesive 170 applications are applied, sometimes referred to as "combed out" with a notched trowel into generally elongate adhesive 170 beads onto the substrate (FIG. 1), preferably to realize an adhesive layer having generally uniform characteristics such as depth of layer and widths of ribbons of adhesive applied through the trowel notches. The trowel is selected such that the shapes of the notches in the trowel correspond to the type of adhesive 170 being used. For example, trowels having v-shaped notches are typically used with mastic adhesives while trowels having square-shaped notches are typically used with thin-set adhesives. Trowel 190 illustrated in FIG. 16 shows an example of square-shaped notches.

After each adhesive application, the user lays tiles 180 upon such adhesive layer. Each tile 180 is individually pressed against the adhesive 170 (FIG. 1). In conventional practice, not part of this invention, the tile is then optionally twisted, in place, in short circular motions back and forth about an axis perpendicular to the plane of the substrate. The twisting of each tile 180 helps apply adhesive 170 onto the back of each tile 180. Preferably, the user applies enough pressure onto the tile 180 while twisting it into place to ensure adhesive 170 coverage while not applying so much pressure as to force adhesive 170 into and upwardly out of the joints between adjacent tiles 180.

In this invention, once a tile 180 is laid into the adhesive 170, there is no need to twist the tile, or to press the tile manually into the adhesive other than to achieve an initial tack on an upstanding substrate. Rather, the user "sets" and/or "levels" the tile by using vibrating tile setting tool 10 so as to establish a relatively level surface across the collective tile upper surface area. To so set the tile, the user energizes vibration mechanism 60 by e.g. depressing button 54 of switch assembly 50.

When the user energizes vibration mechanism 60, vibration mechanism 60 generates a vibration having a vibration frequency of at least about 1,000 VPM, optionally at least about 5,000 VPM, and preferably at least about 7,000 VPM e.g. at least about 7,800 VPM.

The vibration generated by vibration mechanism 60 is imparted through vibration mechanism housing 55, through housing 12 e.g. bottom housing wall 12B, through interface member 114, and ultimately to tile 180 thereby imparting a relatively high frequency vibration to and/or through the tile, facilitating spreading of the adhesive on the back of the tile, and corresponding bonding between the adhesive and the tile. The user vibrates tile 180 at such relatively high frequency until the tile is both (i) in good, intimate contact with the adhesive and (ii) properly positioned in elevation, and leveled, with respect to the other tiles in the tile array.

Once the tiles 180 are set, the adhesive 170 is allowed to dry without being further disturbed, whereafter grout is applied to the tile surface and forced between adjacent tiles 180 into e.g. the joints. The installer wipes excess grout from the surfaces of the tiles 180 by preferably a damp sponge, or otherwise. If desired, the installer "strikes out" grout in excess of the desired amount from the joints between adjacent tiles 180 with a sponge, a cloth, a curved instrument, or otherwise.

After the grout has sufficiently dried/cured, a sealer e.g. a silicone sealer can be applied on the grouted joints, thus sealing the grout.

In some embodiments, vibrating tile setting tool 10 includes as interface member 114 which is adapted and configured to accept at least one additional interface working member (not illustrated), whereupon interface member 114 functions as an intermediate interface member. Such at least one additional interface member includes but is not limited to, interface elements adapted and configured to sand sandable workpieces, to buff and/or otherwise polish buffable and/or polishable workpieces, and others, whereby vibrating tile setting tool 10 comprises a relatively multi-functional power tool, e.g. a power tool suitable to perform functions in addition to tile setting/leveling functions.

As one example, in some embodiments, bottom interface surface 130 of interface member 114 includes hook fasteners and/or loop fasteners, such as those available under the trade name VELCRO® available from Velcro USA Inc. of Manchester, N.H., and such at least one additional interface working member includes a first surface comprising corresponding other ones of hook fastener and/or loop fasteners while a second opposing surface bears embedded sand particles, polishing compound, or the like.

The corresponding hook and loop fasteners on respective ones of such interface member 114 and the at least one additional interface working member enables a user to removably attach such at least one additional interface working member to vibrating tile setting tool 10. One suitable additional interface is a hook and loop sandpaper product, available under the trade name HOOKIT™ available from the 3M™ Company of St. Paul, Minn.

In alternative embodiments, bottom housing wall 12B includes hook fasteners and/or loop fasteners and top interface surface 120 includes the corresponding other ones of hook fasteners whereby a user can removably attach interface member 114, alternatively at least one additional interface working member (not labeled) to bottom housing wall 12B and thus vibrating tile setting tool 10.

In preferred embodiments, components of vibrating tile setting tool 10, e.g. housing 12, flange 14, sidewall 16, housing lid 18, battery holder 26, parts of charging input 30, parts of switch body 50, and others are comprised of suitable non-metallic and/or polymeric materials such as for example and without limitation, various of the polyolefins, such as a variety of the polyethylenes, e.g. high density polyethylene, or polypropylenes. There can also be mentioned as examples such polymers as polyvinyl chloride and chlorinated polyvinyl chloride copolymers, various of the polyamides, polycarbonates, and others. Interface member 114 is generally comprised of a suitable hard rubber compound, hard enough to transfer a substantial portion of the vibrational energy to the tile, soft enough to deflect internally as it transfers energy to the mass of the respective tile.

For any polymeric material employed in structures of the invention, any conventional additive package can be included such as, for example and without limitation, slip agents, anti-block agents, release agents, anti-oxidants, fillers, and plasticizers, to control e.g. processing of the polymeric material as well as to stabilize and/or otherwise control the properties of the finished processed product, also to control hardness, bending resistance, and the like.

Common industry methods of forming such polymeric compounds will suffice to form non-metallic components of drive assembly 56. Exemplary, but not limiting, of such processes are the various commonly-known plastics converting processes, including, without limitation, extruding and injection molding processes.

Some components of vibrating power setting tool 10 e.g. weight 75 preferably comprise brass, alternatively other appropriate metallic materials such as aluminum, steel, stainless steel, titanium, magnesium, and their respective alloys. Common industry methods of forming such metallic materials include casting, forging, shearing, bending, machining, riveting, welding, powdered metal processing, extruding and others.

Vibrating tile setting tool 10 is preferably manufactured as eight components. The eight components are (i) preferably as an integral piece, housing 12, including bottom wall 12B, flange 14, sidewall 16, lip 16C, fingers 27, and vibration mechanism housing 55, (ii) housing lid 18, (iii) interface member 114, (iv) power supply 20 including appropriate circuitry, (v) charging input 30, (vi) switch assembly 50, (vii) motor 65, including output shaft 70, and (viii) weight 75.

In the alternative, one or more of housing 12, flange 14, sidewall 16, lip 16C, fingers 27, and vibration mechanism housing 55 can be separately fabricated, and then joined to each other by known fabrication and/or joinder technologies.

There can be mentioned, for example and without limitation, a wide variety of known joinder technologies such as chemical technologies, thermal technologies and/or mechanical technologies. Common industry methods of joining such materials, such as by using polymer adhesives, thermal bonding, and/or mechanical fasteners will suffice to join one or more of housing 12, flange 14, sidewall 16, lip 16C, fingers 27, and vibration mechanism housing 55 to each other.

There is provided herein a light weight and highly portable, cordless, tile setting tool which vibrates at a high frequency, and which has a relatively high ratio of frequency of vibration to mass of the tool (FRAM). While certain masses and certain vibration frequencies have been set forth as examples of suitable masses and vibration frequencies, all masses within the ranges of example masses, and all frequencies within the ranges of the cited frequencies, are considered as much a part of the invention as the cited frequencies and masses. The following exemplary ratios, and others, can be calculated from the above noted masses and frequencies.

| Frequency cycles/min | Mass pounds | Freq/Mass (FRAM) |
|---|---|---|
| 1000 | 5# | 200 |
| 3000 | 5# | 600 |
| 7800 | 5# | 1560 |
| 3000 | 33 | 1000 |
| 7800 | 3# | 2600 |
| 5000 | 1# | 5000 |
| 1000 | 1# | 1000 |
| 7000 | 0.9# | 7777 |
| 1000 | 0.9# | 1111 |
| 7800 | 0.9# | 8667 |

Choosing to not be bound by theory, the inventor contemplates that the relatively high speed of rotation of motor 65, optionally in combination with the relatively low mass of power tool 10, and the mounting off-set of weight 75, provide a frequency and amplitude of vibration which is effective to reduce the viscosity of the mud immediately adjacent to the vibrating tile. Applicant contemplates that the mud viscosity declines enough to facilitate rapid placement/setting of the tile in the desired location in the tile array. Further, and still not being bound by theory, the inventor contemplates that such lower viscosity characteristics of the mud is limited to that portion of the mud which is closely adjacent the tile.

The inventor herein has observed that, without energizing power tool 10, the tool provides no unexpected functional benefit in setting a tile. However, when the tool is energized at e.g. 7800 RPM, the vibration imparted to the tile creates an environment at the tile-mud interface wherein the tile is easily moved to a desired location and, with minimal effort on the part of the installer, is set at any desired height and orientation in the tile array. So long as the tool is energized, the tile can be moved about at will. When the tile is in the desired location, the tool is de-energized whereupon the tile is relatively more fixed in position, and does not readily move. At that point, the tool is removed from the tile with little if any risk of displacing the tile from the fixed location, as the tile is relatively no longer mobile.

In the process of using power tool 10, a certain amount of downward force is applied to the tile-mud interface. The elements of that downward force include the weight of power tool 10, the weight of the tile 180, and any downward force which may be applied by the installer.

It is common knowledge in the art that when an installer hand sets a tile, e.g. without the use of power tool 10, the installer applies substantial force to the tile as he twists the tile and otherwise attempts to get the tile down to the proper height, and level/aligned with the remaining tiles in the array. The inventor herein has discovered that a similar amount of force is needed even with tool 10 if the tool is not energized. However, as soon as the tool is energized, the amount of downward force which must be applied by the installer is greatly reduced, thereby reducing installer/user fatigue, and increasing installer productivity. However, as needed for e.g. a larger tile, or a more viscous mud, the installer can apply additional manual downward force, whereby the effectiveness of the tool is defined by the installer in real time according to the needs of the particular job.

Still without being bound by theory, the inventor herein contemplates that for every mud, and given a mass for tool 10, and a given mass offset of weight 75, there is a threshold rate of vibration/frequency above which the increase in mobility of the mud imposed by the vibration of the tool is a non-linear function of the frequency of vibration of the tool; and wherein below the threshold frequency the mobility of the tile is improved little, if any, over the mobility of the tile absent power tool 10. Such threshold frequency is expected to be relatively higher for a relatively higher viscosity mud, relatively lower for a relatively lower viscosity mud. The inventor herein contemplates that, so long as the frequency of vibration is at or above the threshold frequency, the tile will be mobile, and easily set as described herein.

While the present invention is illustrated with reference to a particular vibrating tile setting tool having a particular configuration and particular features, the present invention is not limited to such configuration or to such features, whereby other configurations and features can be employed in combination with the invention.

Similarly, while the disclosure hereof is detailed and exact to enable those skilled in the art to practice the invention, the invention can be, embodied in other structures in addition to the illustrated exemplary structures.

Those skilled in the art will now see that certain modifications can be made to the apparatus and methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

The scope of the invention is defined in the claims appended hereto. To the extent the following claims use means plus function language, it is not meant to include there, or in the instant specification, anything not structurally equivalent to what is shown in the embodiments disclosed in the specification.

Having thus described the invention, what is claimed is:

1. A vibrating tile setting tool adapted and configured to interface with an upper surface of a tile, thereby to facilitate setting said tile in mud, said vibrating tile setting tool comprising:

(a) a housing including a bottom wall with an aperture formed therethrough, a sidewall extending upward from said bottom wall which cooperates with said bottom wall to define a housing cavity, and a flange extending outward from said bottom wall beyond said sidewall;

(b) a power supply disposed within said housing cavity;

(c)a vibration mechanism located in said housing cavity, said vibration mechanism including a motor positioned above said bottom wall, said motor having an output shaft extending outward therefrom and passing through said aperture, said output shaft capable of rotating about an axis of rotation, a weight attached to said output shaft, said weight capable of rotating about an axis of rotation which is generally coaxially aligned with said axis of rotation of said output shaft, and a tile interface member secured to said flange outward of said sidewall, said tile interface member having a bottom surface adapted and configured to communicate with said upper surface of said tile, said vibrating mechanism capable of vibrating said housing when said vibration mechanism is activated, said vibration mechanism being effective to produce a vibration frequency, in said housing, of at least about 1,000 vibrations per minute; and said vibrating tile setting tool, in operation, having a total mass of no more than 5 pounds, whereby said vibrating tile setting tool realizes a vibration frequency to mass ratio of at least about 200 vibrations per minute per pound mass.

2. The vibrating tile setting tool of claim 1 wherein said power supply is a cordless, rechargeable DC power supply.

3. The vibrating tile setting tool of claim 1 wherein said vibrating tile setting tool has a total mass of less than about 3 pounds and a vibration frequency to mass ratio of at least about 600 vibrations per minute per pound mass.

4. The vibrating tile setting tool of claim 1 wherein said vibrating tile setting tool has a total mass of less than about 1 pound, and said vibrating tile setting tool has a level mounted to said housing which is conspicuously displayed during use of said vibrating tile setting tool.

5. The vibrating tile setting tool of claim 4 wherein said output shaft is adapted and configured to rotate at an rpm of at least about 1000 rpm and said level is a bubble level.

6. The vibrating tile setting tool of claim 5 wherein said housing defines a hand grip adapted and configured to be grasped by a user by applying a relatively flattened palm, and partially flexed fingers, of a user's generally open hand to said hand grip, said hand grip further provides a function of said housing associated with enclosing contained elements of said tile setting tool, and said housing includes a lid having a rigid rim which is friction fitted to a lip formed on an upper surface of said sidewall.

7. The vibrating tile setting tool of claim 5 wherein said vibrating tile setting tool has a total mass of no more than about 1 pound and a vibration frequency to mass ratio of at least about 600 vibrations per minute per pound mass.

8. The A vibrating tile setting tool of claim 5 wherein said vibrating tile setting tool has a total mass of no more than about 1 pound and a vibration frequency to mass ratio of at least about 1,000 vibrations per minute per pound mass.

9. The vibrating tile setting tool of claim 1 wherein said bottom surface of said tile interface member has generally constant point-to-point surface elevations whereby generally the entirety of that projected portion of said bottom surface which faces a top surface of a tile is in contact with said tile when said tile setting tool is being used on said tile.

10. The vibrating tile setting tool of claim 1 wherein said vibration mechanism vibrates at a frequency sufficiently high to substantially reduce viscosity of a tile setting mud at a tile-mud interface when said vibrating tile setting tool is set on said tile and energized.

11. The vibrating tile setting tool of claim 1 wherein said vibrating tile setting tool, in operation, has a ratio of vibration frequency to total mass of at least 5,000 vibrations per minute per pound mass, and wherein said vibration mechanism vibrates at a frequency sufficiently high to substantially reduce viscosity of a tile setting mud at a tile-mud interface when said vibrating tile setting tool is set on such tile and energized.

12. The vibrating tile setting tool of claim 1 wherein said bottom wall has at least two spaced apart fingers secured thereto and said power supply is a battery pack that is friction fit between said fingers.

13. The vibrating tile setting tool of claim 12 wherein said vibrating tile setting tool, in operation, has a ratio of vibration frequency to total mass of at least 5,000 vibrations per minute per pound mass.

14. The vibrating tile setting tool of claim 13 wherein said vibrating tile setting tool, in operation, has a ratio of vibration frequency to total mass of at least 7,000 vibrations per minute per pound mass.

15. A vibrating tile setting tool adapted and configured to interface with an upper surface of a tile, thereby to facilitate setting said tile in mud, said vibrating tile setting tool comprising:

(a) a housing having a bottom wall with an aperture formed therethrough, at least one sidewall extending upwardly from said bottom wall, said sidewall and said bottom wall cooperating to define a housing cavity, and a flange extending outward from said bottom wall beyond said at least one sidewall;

(b) a tile interface member secured to said flange, said tile interface member having a bottom surface which is configured to contact an upper surface of a tile which is to be set into an adhesive;

(c) a vibration mechanism located within said housing cavity, said vibration mechanism including a motor having a first terminal end with an output shaft extending outward from said first terminal end, said output shaft passing through said aperture and capable of rotating about an axis of rotation, and a weight attached to said output shaft, said weight capable of rotating about an axis of rotation which is generally coaxially aligned with said axis of rotation of said output shaft;

(d) a self-contained, rechargeable DC power supply disposed within said housing cavity; and (e) a charging input mounted to said housing and communicating with said self-contained power supply, whereby said charging input is adapted and configured to facilitate energizing at least one of said vibration mechanism and said self-contained power supply.

16. The vibrating tile setting tool of claim 15 further including a level mounted to said housing, said level being conspicuously displayed, and said level being aligned with said bottom surface of said tile interface member.

17. The vibrating tile setting tool of claim 15 wherein said level is a bubble level.

18. The vibrating tile setting tool of claim 15 wherein said vibrating tile setting tool has a total mass of less than about 3 pounds and a vibration frequency to mass ratio of at least about 600 vibrations per minute per pound mass.

19. The vibrating tile setting tool of claim 18 wherein said vibrating tile setting tool has a total mass of less than about 1 pound and a vibration frequency to mass ratio of at least about 1,000 vibrations per minute per pound mass.

20. The vibrating tile setting tool of claim 19 wherein said vibrating tile setting tool vibrates at a frequency of at least 5,000 vibrations per minute.

21. The vibrating tile setting tool of claim 20 wherein said vibration mechanism vibrates at a frequency sufficiently high to substantially reduce viscosity of a tile setting mud at a tile-mud interface when said vibrating tile setting tool is set on said tile and energized.

22. The vibrating tile setting tool of claim 21 wherein said vibrating tile setting tool has a total mass of no more than about 1 pound and a vibration frequency to mass ratio of at least about 1,000 vibrations per minute per pound mass.

23. The vibrating tile setting tool of claim 18 wherein said bottom wall has at least two spaced apart fingers secured thereto and said power supply is a battery pack that is friction fit between said fingers.

24. The vibrating tile setting tool of claim 15 wherein said housing defines a hand grip adapted and configured to be grasped by a user by applying a relatively flattened palm, and partially flexed fingers, of a user's generally open hand to said hand grip, and wherein said hand grip further provides a function of said housing associated with enclosing contained elements of said tile setting tool.

25. The vibrating tile setting tool of claim 15 wherein vibration of said vibration mechanism is actuated along a generally upright axis and perpendicular to said tile interface member.

26. The vibrating tile setting tool of claim 15 wherein said bottom surface of said tile interface member has generally constant point-to-point surface elevations whereby generally the entirety of that projected portion of said bottom surface which faces a top surface of a tile is in contact with said tile when said tile setting tool is being used on said tile.

27. The vibrating tile setting tool of claim 15 wherein said vibration mechanism vibrates at a frequency sufficiently high to substantially reduce viscosity of a tile setting mud at a tile-mud interface when said vibrating tile setting tool is set on said tile and energized.

28. The vibrating tile setting tool of claim 27 wherein said vibrating tile setting tool has a total mass of no more than about 1 pound and a vibration frequency to mass ratio of at least about 600 vibrations per minute per pound mass.

29. The vibrating tile setting tool of claim 15 wherein said vibrating tile setting tool, in operation, has a ratio of vibration frequency to total mass of at least 200 vibrations per minute per pound mass.

30. The vibrating tile setting tool of claim 15 wherein said vibrating tile setting tool, in operation, has a ratio of vibration frequency to total mass of at least 1,000 vibrations per minute per pound mass.

31. The vibrating tile setting tool of claim 15 wherein said vibrating tile setting tool, in operation, has a ratio of vibration frequency to total mass of at least 5,000 vibrations per minute per pound mass.

32. The vibrating tile setting tool of claim 15 wherein said vibrating tile setting tool, in operation, has a ratio of vibration frequency to total mass of at least 7,000 vibrations per minute per pound mass.

33. A vibrating tile setting tool adapted and configured to interface with an upper surface of a tile, thereby to facilitate setting said tile in mud, said vibrating tile setting tool comprising:

(a) a housing having a bottom wall with an aperture formed therethrough, at least one sidewall extending upwardly from said bottom wall, said sidewall and said bottom wall cooperating to define a housing cavity;

(b) a rechargeable DC power supply disposed within said housing cavity;

(c) a vibration mechanism attached to said housing and located within said housing cavity, said vibration mechanism including a motor positioned above said bottom wall, said motor having an output shaft extending outward therefrom and passing through said aperture, said output shaft capable of rotating about an axis of rotation, a weight attached to said output shaft, said weight capable of rotating about an axis of rotation which is generally coaxially aligned with said axis of rotation of said output shaft, and said vibrating mechanism capable of vibrating said housing when said vibration mechanism is activated, said vibration mechanism being effective to produce a vibration freguency, in said housing, of at least about 1,000 vibrations per minute; and (d) a tile interface member having a bottom surface, said bottom surface being adapted and configured to communicate with a tile to be set, said bottom surface, in a rest configuration, being generally planar, allowing for gravity-induced droop.

34. The vibrating tile setting tool of claim 33 further including a level mounted to said housing, said level being conspicuously displayed, and said level being aligned with said bottom surface of said tile interface member.

35. The vibrating tile setting tool of claim 34 wherein said level is a bubble level, and said power supply is secured to said bottom wall of said housing.

36. The vibrating tile setting tool of claim 33 wherein said vibrating tile setting tool has a total mass of less than about 3 pounds and a vibration frequency to mass ratio of at least about 600 vibrations per minute per pound mass.

37. The vibrating tile setting tool of claim 33 wherein said vibrating tile setting tool has a total mass of less than about 1 pound and a vibration frequency to mass ratio of at least about 1,000 vibrations per minute per pound mass.

38. The vibrating tile setting tool of claim 37 wherein said vibrating tile setting tool vibrates at a frequency of at least 5,000 vibrations per minute.

39. The vibrating tile setting tool of claim 38 wherein said vibration mechanism vibrates at a frequency sufficiently high to substantially reduce viscosity of a tile setting mud at a tile-mud interface when said vibrating tile setting tool is set on said tile and energized.

40. The vibrating tile setting tool of claim 39 wherein said vibrating tile setting tool has a total mass of no more than about 1 pound and a vibration frequency to mass ratio of at least about 1,000 vibrations per minute per pound mass.

41. The vibrating tile setting tool of claim 33 wherein said bottom wall has at least two spaced apart fingers secured thereto and said power supply is a battery pack that is friction fit between said fingers.

42. The vibrating tile setting tool of claim 33 wherein said housing defines a hand grip adapted and configured to be grasped by a user by applying a relatively flattened palm, and partially flexed fingers, of a user's generally open hand to said hand grip, and wherein said hand grip further provides a function of said housing associated with enclosing contained elements of said tile setting tool.

43. The vibrating tile setting tool of claim 33 wherein vibrations of said vibration mechanism are actuated along a generally upright axis and prependicular to said tile interface member.

44. The vibrating tile setting tool of claim 43 wherein said vibration mechanism vibrates at a frequency sufficiently high to substantially reduce viscosity of a tile setting mud at a tile-mud interface when said vibrating tile setting tool is set on said tile and energized.

45. The vibrating tile setting tool of claim 44 wherein said vibrating tile setting tool has a total mass of no more than about 1 pound and a vibration frequency to mass ratio of at least about 600 vibrations per minute per pound mass.

46. The vibrating tile setting tool of claim 43 wherein said tile interface member communicates with said bottom wall and is generally perpendicular to said axis of rotation of said output shaft.

47. The vibrating tile setting tool of claim 33 wherein said vibrating tile setting tool, in operation, has a ratio of vibration frequency to total mass of at least 200 vibrations per minute per pound mass.

48. The vibrating tile setting tool of claim 33 wherein said vibrating tile setting tool, in operation, has a ratio of vibration frequency to total mass of at least 1,000 vibrations per minute per pound mass.

49. The vibrating tile setting tool of claim 33 wherein said vibrating tile setting tool, in operation, has a ratio of vibration frequency to total mass of at least 5,000 vibrations per minute per pound mass.

50. The vibrating tile setting tool of claim 33 wherein said vibrating tile setting tool, in operation, has a ratio of vibration frequency to total mass of at least 7,000 vibrations per minute per pound mass.

* * * * *